US009199487B2

(12) United States Patent
Maeda

(10) Patent No.: US 9,199,487 B2
(45) Date of Patent: Dec. 1, 2015

(54) CONTINUOUS PAPER CONVEYANCE DEVICE, AND PRINTER

(71) Applicant: SEIKO EPSON CORPORATION, Tokyo (JP)

(72) Inventor: Hiroyuki Maeda, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 13/960,047

(22) Filed: Aug. 6, 2013

(65) Prior Publication Data

US 2014/0043390 A1 Feb. 13, 2014

(30) Foreign Application Priority Data

Aug. 8, 2012 (JP) ..... 2012-175754

(51) Int. Cl.

| | |
|---|---|
| ***B41J 29/38*** | (2006.01) |
| ***B41J 2/01*** | (2006.01) |
| ***B41J 11/00*** | (2006.01) |
| ***B41J 11/30*** | (2006.01) |
| ***B41J 15/04*** | (2006.01) |

(52) U.S. Cl.

CPC ..... *B41J 11/006* (2013.01); *B41J 11/30* (2013.01); *B41J 15/04* (2013.01); *B41J 29/38* (2013.01)

(58) Field of Classification Search

CPC ..... B41J 11/006
USPC ..... 347/16, 101, 104–105
See application file for complete search history.

(56) References Cited

U.S. PATENT DOCUMENTS

| | | | | |
|---|---|---|---|---|
| 7,360,887 | B2 * | 4/2008 | Konno | 347/103 |
| 2004/0126166 | A1 * | 7/2004 | Miyake | 400/74 |
| 2009/0015627 | A1 * | 1/2009 | Takahashi | 347/32 |
| 2011/0200378 | A1 | 8/2011 | Moriyama | |
| 2012/0019580 | A1 * | 1/2012 | Tokushima | 347/14 |
| 2012/0050439 | A1 * | 3/2012 | Kawasaki et al. | 347/104 |
| 2012/0140012 | A1 * | 6/2012 | Saito et al. | 347/104 |
| 2013/0044151 | A1 * | 2/2013 | Masuda et al. | 347/16 |

FOREIGN PATENT DOCUMENTS

| | | | |
|---|---|---|---|
| JP | 6172549 | A | 4/1986 |
| JP | 6481739 | A | 3/1989 |
| JP | 236858 | U | 3/1990 |
| JP | 2002144653 | A | 5/2002 |
| JP | 2005178307 | A | 7/2005 |
| JP | 2011168365 | A | 9/2011 |

* cited by examiner

*Primary Examiner* — Jason Uhlenhake
(74) *Attorney, Agent, or Firm* — Hauptman Ham, LLP

(57) ABSTRACT

A conveyance device 20 of an inkjet printer 1 has a discharge roller 46 disposed on the downstream side of the printing position A in the forward conveyance direction, and a paper jam detector 83 disposed on the downstream side of the discharge roller 46. The paper jam detector 83 includes a driven roller 84, driven pressure roller 85, and an encoder 86 that detects the angle of rotation of the driven roller 84 . The driven roller 84 turns following movement of the continuous paper 2 passing between the driven roller 84 and driven pressure roller 85. The control unit 90 of the inkjet printer 1 detects occurrence of a paper jam based on the difference between the angle of rotation of the driven roller 84 and a reference angle of rotation when the conveyance motor 60 continues driving after the continuous paper has passed through the conveyance path 21.

7 Claims, 5 Drawing Sheets

CONTINUOUS PAPER CONVEYANCE DEVICE, AND PRINTER

RELATED APPLICATIONS

The present application is based on, and claims priority from, Japanese Application Number 2012-175754, filed Aug. 8, 2012, the disclosure of which is hereby incorporated by reference herein in its entirety.

BACKGROUND

1. Technical Field

The present disclosure relates to a printer that prints on continuous paper, and relates more particularly to a continuous paper conveyance device having means of detecting if continuous paper is jammed in the conveyance path, and to a printer having the conveyance device.

2. Related Art

Printers that print on fanfold paper or other continuous paper and use a tractor and paper feed roller as the conveyance mechanism that conveys the continuous paper are known from the literature. See, for example, Japanese Unexamined Patent Appl. Pub. JP-A-2011-168365. The printer disclosed in JP-A-2011-168365 has sensors (paper detectors) located just before the paper feed roller for detecting the leading end of the continuous paper supplied from the tractor side. This printer detects the presence of continuous paper before the paper feed roller based on output from these sensors, and controls conveying the continuous paper based on the result of detecting continuous paper.

Because sensors for detecting paper are located on the upstream side of the printhead in the printer taught in JP-A-2011-168365, problems such as a paper jam occurring upstream from the printhead can be detected when the paper does not reach the position of the sensors. More specifically, paper jams that occur before the paper is supplied to the printing position can be detected. When an inkjet head is used as the printhead and a paper jam occurs between the inkjet head and the platen, the printhead can be damaged by contact between the printhead and the paper. Detecting a paper jam at the printing position and removing the jammed paper as quickly as possible is therefore necessary.

However, after the paper has entered the conveyance path and printing has started, paper jams cannot be detected from the sensor signals output by the sensors that detect the presence of paper as described in JP-A-2011-168365.

When the paper exit of the printer is blocked so that the continuous paper cannot be discharged and the paper jams at the downstream end of the conveyance path, there is a delay until the downstream paper jam affects the upstream side, and the sensors on the upstream side of the printing position cannot quickly detect paper jams occurring on the downstream side. If paper jam detection is delayed, the stuck paper cannot be quickly removed, and preventing damage caused by the inkjet head moving while paper is jammed is difficult.

SUMMARY

The present disclosure is directed to solving the foregoing problem, and provides a continuous paper conveyance device that can quickly detect a paper jam even after the paper has travelled through the conveyance path, and a printer having the continuous paper conveyance device.

A continuous paper conveyance device in accordance with some embodiments includes a tractor that conveys continuous paper through a conveyance path passed the printing position of a printhead while sequentially engaging engaging parts in engaging holes formed along the length of the continuous paper, a paper feed roller that conveys the continuous paper through the conveyance path at a position on the conveyance path between the tractor and the printing position, and a paper jam detector disposed on the downstream side of the printing position in the conveyance direction from the tractor to the printing position on the conveyance path.

Preferably, the paper jam detector includes a driven roller that rotates following the conveyed continuous paper, and a rotation detection unit that detects the angle of rotation of the driven roller.

By having a driven roller that turns following the conveyed continuous paper and a rotation detection unit that detects rotation of the driven roller, the disclosure can detect paper jams that occur after the paper has passed through the conveyance path and cannot be detected by a paper detector according to the related art that detects the presence of continuous paper upstream. Furthermore, because the paper jam detector is located downstream from the printing position, paper jams occurring downstream from the printing position on the conveyance path can be quickly detected before the paper jam affects the printing position. Media conveyance can therefore be stopped quickly and the continuous paper removed, thereby preventing printhead damage caused by contact between the continuous paper and printhead.

A continuous paper conveyance device according to another aspect of the embodiments preferably also includes a sensor that detects the continuous paper at a position on the upstream side of the printing position in the conveyance direction, and detects a paper jam based on a signal from the rotation detection unit based on the continuous paper being detected by the sensor.

By detecting paper jams in conjunction with paper detection by an upstream sensor, paper jam detection can be limited to when the continuous paper has been normally conveyed through the upstream side of the conveyance path. Paper jams can therefore be detected accurately, and executing the detection process needlessly can be avoided.

Yet further preferably, the continuous paper conveyance device according to another aspect of the embodiments the paper jam detector includes a driven pressure roller that presses the continuous paper to the driven roller; and the pressure applied by the driven pressure roller is set so that the static friction between the driven roller and the continuous paper is greater than the rotational load of the driven roller.

This aspect of the embodiments can make the driven roller reliably follow the conveyed continuous paper. Paper jams can therefore be accurately detected.

The continuous paper conveyance device according to another aspect of the embodiments preferably also includes a discharge roller disposed near the paper jam detector on the upstream side in the conveyance direction, and the pressure applied by the driven pressure roller is set according to the distance in the conveyance direction between the discharge roller and the driven roller, and the stiffness of the continuous paper.

If the driven pressure roller applies too much pressure, resistance may be excessive when the continuous paper passes between the driven roller and driven pressure roller, causing the paper to become creased and the creased paper to become stuck, resulting in a paper jam. The paper is less likely to become creased (crumpled) if the distance between the driven roller and the discharge roller is sufficient because the paper can move more freely, or if the paper is sufficiently stiff. By setting the pressure of the driven pressure roller in the paper jam detector according to the distance between the driven roller and the discharge roller and the stiffness of the paper, paper jams can be prevented in the paper jam detector, and paper jams can be accurately detected.

Yet further preferably, the continuous paper conveyance device has a friction layer formed by a dispersion of inorganic particles in the surface of the paper feed roller.

This increases the friction coefficient of the paper feed roller surface, and substantially eliminates slipping between the continuous paper and the paper feed roller. The media conveyance precision of the paper feed roller can therefore be improved.

Another aspect of the embodiments is a printer having the continuous paper conveyance device described above, and a print unit that prints at the printing position on the continuous paper conveyed by the continuous paper conveyance device.

Further preferably, the print unit of the printer has an inkjet head that ejects ink droplets onto the continuous paper.

This aspect of the disclosure can suppress damage to the inkjet head due to contact with the continuous paper.

EFFECT OF THE DISCLOSURE

The disclosure can detect paper jams after paper has passed through the conveyance path, and can quickly detect a paper jam that occurs at the downstream side of the conveyance path before the paper jam affects the printing position. Paper conveyance can therefore be stopped quickly and the continuous paper removed, and printhead damage due to contact between the continuous paper and printhead can be suppressed.

Other objects and attainments together with a fuller understanding of the disclosure will become apparent and appreciated by referring to the following description and claims taken in conjunction with the accompanying drawings.

DESCRIPTION OF EMBODIMENTS

Preferred embodiments of a continuous paper conveyance device according to the present disclosure and a printer having the continuous paper conveyance device are described below with reference to the accompanying figures.

General Configuration

Figure 1:
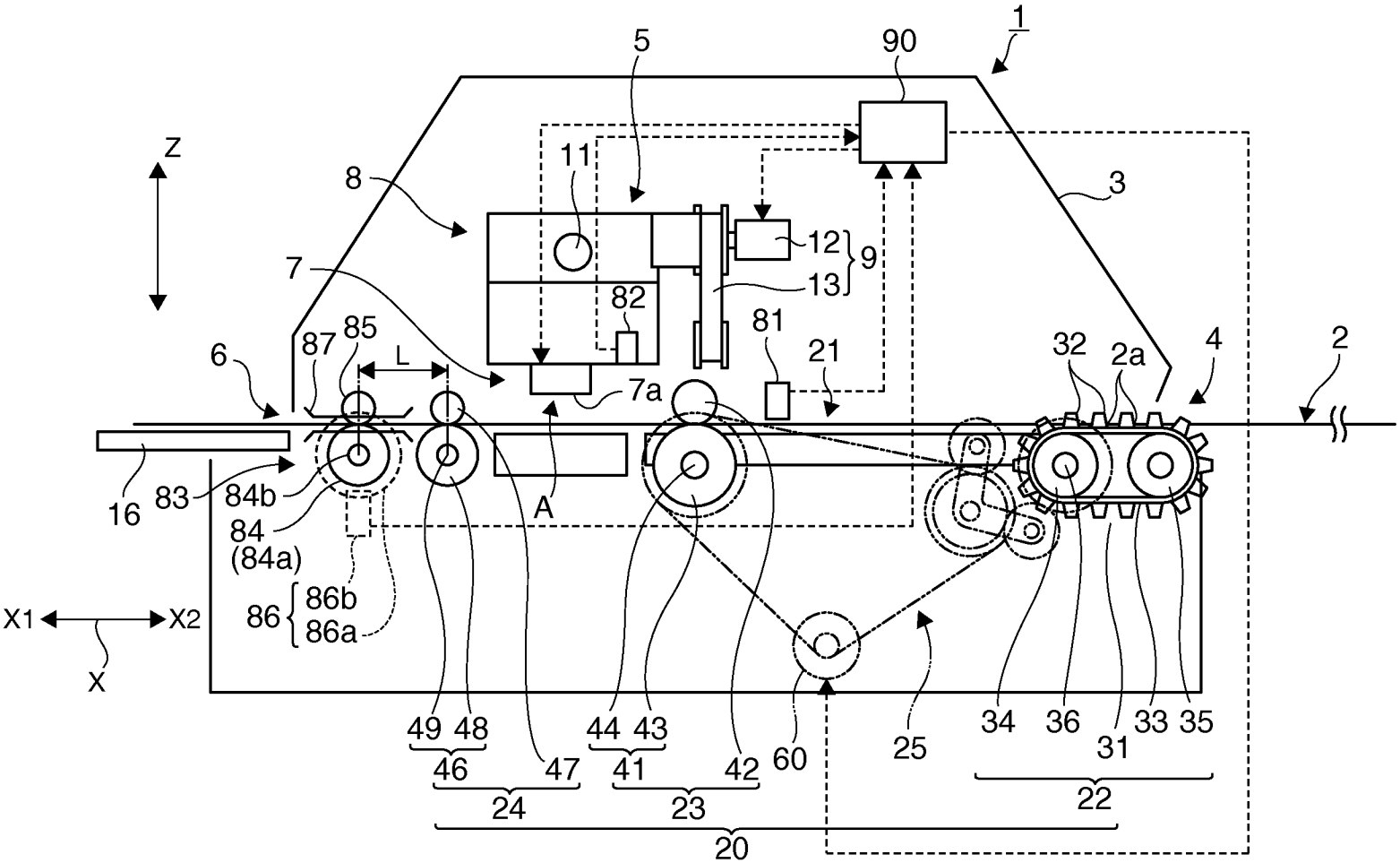
FIG. 1 is an inkjet printer view in accordance with some embodiments.

FIG. 1 is the overall configuration of an inkjet printer view according to this embodiment of the disclosure. The inkjet printer 1 pulls continuous paper 2 through the supply opening 4 disposed in the back of the printer case 3, prints on the continuous paper 2 with the print unit 5, and discharges the continuous paper 2 from a paper exit 6 disposed in the front of the printer case 3.

The print unit 5 includes a printhead 7, carriage 8, and carriage moving mechanism 9. The printhead 7 is an inkjet head and has a plurality of nozzles 7*a* that eject ink droplets onto the continuous paper 2. The printhead 7 is mounted on the carriage 8 with the nozzles 7*a* facing down on the z-axis shown in FIG. 1, that is, facing the continuous paper 2.

The carriage 8 is supported movably along a carriage shaft 11 that extends in the transverse direction Y widthwise to the paper, and is moved bidirectionally in the transverse direction Y by the carriage moving mechanism 9. The carriage moving mechanism 9 includes a carriage motor 12 and a timing belt 13 that is driven by the carriage motor 12. The carriage 8 is affixed to the timing belt 13, and is moved bidirectionally according to the operation of the carriage motor 12.

Figure 2:
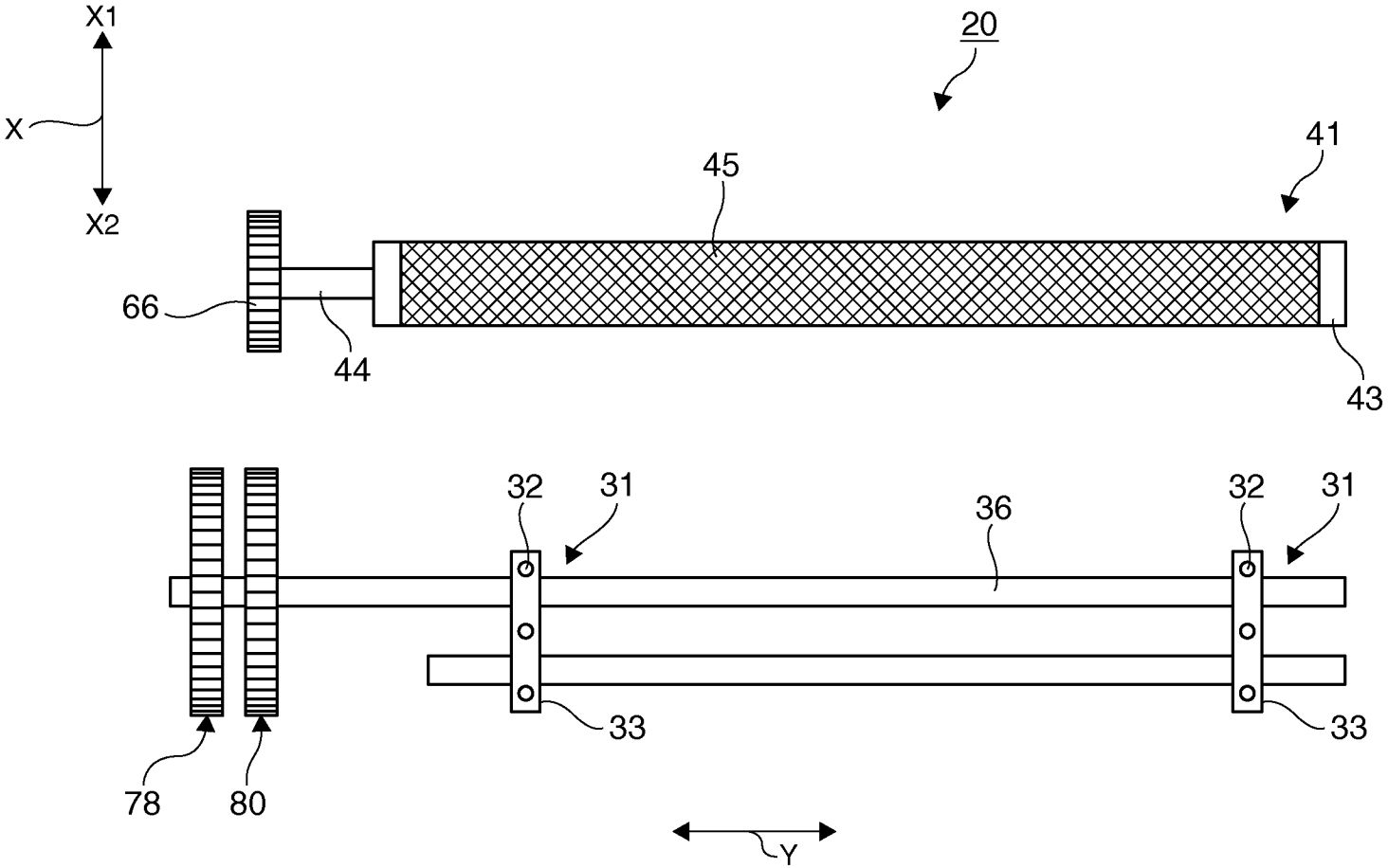
FIG. 2 is a plan view showing part of the conveyance device in the inkjet printer shown in FIG. 1.
Figure 3:
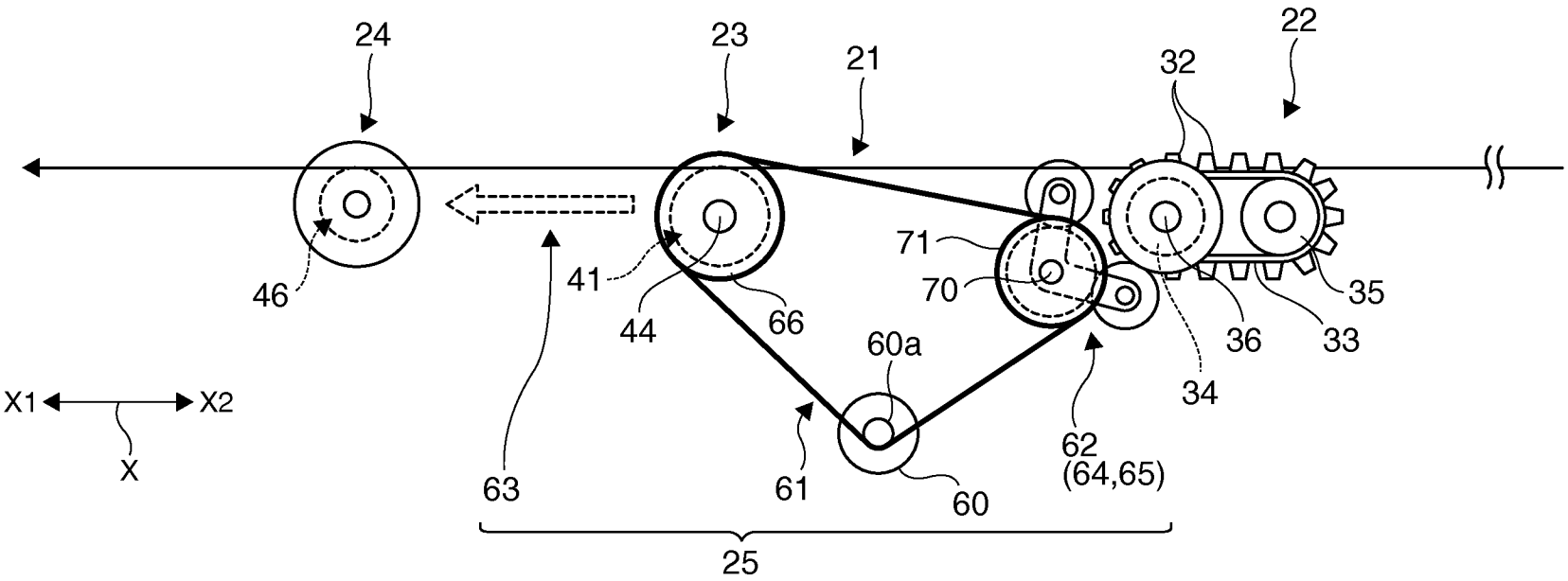
FIG. 3 is a side view showing the power transfer mechanism in the conveyance device of the inkjet printer shown in FIG. 1.

The inkjet printer 1 also has a conveyance device 20 (continuous paper conveyance device) that conveys the continuous paper 2. FIG. 2 is a plan view of the conveyance device 20. FIG. 3 is a side view of the conveyance device 20 in the inkjet printer 1.

As described with reference to FIG. 1 to FIG. 3, the conveyance device 20 includes a conveyance path 21, first conveyance mechanism 22, second conveyance mechanism 23, third conveyance mechanism 24, and power transfer mechanism 25. The power transfer mechanism 25 is not shown in FIG. 2.

The conveyance path 21 extends in the direction of arrow X in FIG. 1, starting from the supply opening 4, passing the printing position A of the printhead 7 of the print unit 5, and ending at the paper exit 6. The first conveyance mechanism 22, second conveyance mechanism 23, print unit 5, and third conveyance mechanism 24 are disposed in this order along the conveyance path 21 from the supply opening 4 at the upstream side to the paper exit 6 on the downstream side.

The first conveyance mechanism 22 is disposed near the supply opening 4 and has a pair of tractors 31. Each tractor 31 has tractor pins 32, a tractor belt 33, a drive sprocket 34, and a driven sprocket 35. The tractor pins 32 are engaging members that can be inserted to the sprocket holes (engagement holes) 2*a* of the continuous paper 2, and are disposed at a specific interval on the outside surface of the tractor belt 33. The tractor belt 33 is mounted on the drive sprocket 34 and driven sprocket 35.

The pair of tractors 31 are disposed as shown in FIG. 2 on opposite sides of the width of the conveyance path 21 (transverse direction Y). The tractors 31 are set to positions matching the sprocket holes 2*a* in the opposite sides of the conveyed continuous paper 2. The drive sprocket 34 of each tractor 31 is connected to the drive-side tractor shaft 36, and the tractors 31 are driven synchronously.

The second conveyance mechanism 23 is disposed between the first conveyance mechanism 22 and the printing position A on the conveyance path 21, and more specifically close to the printhead 7. The second conveyance mechanism 23 includes a paper feed roller 41 (conveyance roller) and a pressure roller 42. The paper feed roller 41 includes a metal roller 43 and a roller shaft 44, and is disposed transverse to the conveyance path 21 at a position below the conveyance path 21 on the z-axis. The pressure roller 42 is made of rubber or other elastic material, and is disposed to press the continuous paper 2 conveyed through the conveyance path 21 against the paper feed roller 41 from above on the z-axis.

As shown in FIG. 2, the surface of the roller 43 has a friction coating 45 formed by a dispersion of inorganic particles. The friction coating 45 is formed by dispersing inorganic particles of aluminum oxide (alumina, $Al_2O_3$), silicon monoxide (SiO), or silicon dioxide ($SiO_2$), for example, in a layer of epoxy or polyester resin. This embodiment uses crushed alumina as the inorganic particles. Alumina is relative inexpensive and does not interfere with reducing cost, is relatively hard, and desirably improves friction resistance.

The crushing process also produces alumina particles with sharp corners, resulting in high friction force.

The third conveyance mechanism 24 is disposed between the printing position A on the conveyance path 21 and the paper exit 6, and more specifically near the printhead 7. The third conveyance mechanism 24 includes a discharge roller 46 and a pressure roller 47. The discharge roller 46 includes a roller 48 and a roller shaft 49, and is disposed transverse to the conveyance path 21 at a position below the conveyance path 21 on the z-axis. The pressure roller 47 is disposed to press the continuous paper 2 conveyed through the conveyance path 21 against the discharge roller 46 from above on the z-axis.

As described next with reference to FIG. 3, the conveyance device 20 has a conveyance motor 60 as the paper conveyance drive source. The power transfer mechanism 25 has a roller-side power transfer mechanism 61 and a tractor-side power transfer mechanism 62.

The roller-side power transfer mechanism 61 transfers forward rotation for conveying the continuous paper 2 forward (in the direction of arrow X1) through the conveyance path 21, and reverse rotation for conveying the paper in reverse (the direction of arrow X2), from the conveyance motor 60 to the paper feed roller 41 of the second conveyance mechanism 23.

The tractor-side power transfer mechanism 62 transfers rotation from the conveyance motor 60 to the first conveyance mechanism 22. The drive power transfer mechanism 25 also has a gear train 63. The gear train 63 is denoted by a dotted line in FIG. 3 but the specific configuration thereof is not shown. The gear train 63 causes the discharge roller 46 of the third conveyance mechanism 24 to rotate synchronously at the same speed in the same direction as the paper feed roller 41 of the second conveyance mechanism 23.

The tractor-side power transfer mechanism 62 includes a forward power transfer mechanism 64 that transfers forward rotation from the conveyance motor 60 through a one-way clutch to the first conveyance mechanism 22, and a reverse power transfer mechanism 65 that transfers reverse rotation from the conveyance motor 60 through a torque limiter (torque clutch) to the first conveyance mechanism 22, as further described with reference to FIG. 4.

When conveying the continuous paper 2 forward in this embodiment, the conveyance speed of the continuous paper 2 conveyed by the paper feed roller 41 driven through the roller-side power transfer mechanism 61 is greater than the conveyance speed of the continuous paper 2 conveyed by the tractors 31 driven through the forward power transfer mechanism 64. The speed reduction ratios of the wheel trains in the transfer mechanisms are set to achieve this relationship.

Conversely, when conveying the paper in reverse, the conveyance speed of the continuous paper 2 conveyed by the tractors 31 driven through the reverse power transfer mechanism 65 is greater than the conveyance speed of the continuous paper 2 conveyed by the paper feed roller 41 driven through the roller-side power transfer mechanism 61. The speed reduction ratios of the wheel trains in the transfer mechanisms are set to achieve this relationship.

The roller-side power transfer mechanism 61 includes a drive sprocket 60*a* fixed coaxially to the output shaft of the conveyance motor 60, a drive gear 66 fixed coaxially to the end part of the roller shaft 44 of the paper feed roller 41 in the second conveyance mechanism 23, and a timing belt 67 mounted on the drive sprocket 60*a* and drive gear 66.

Figure 4A:
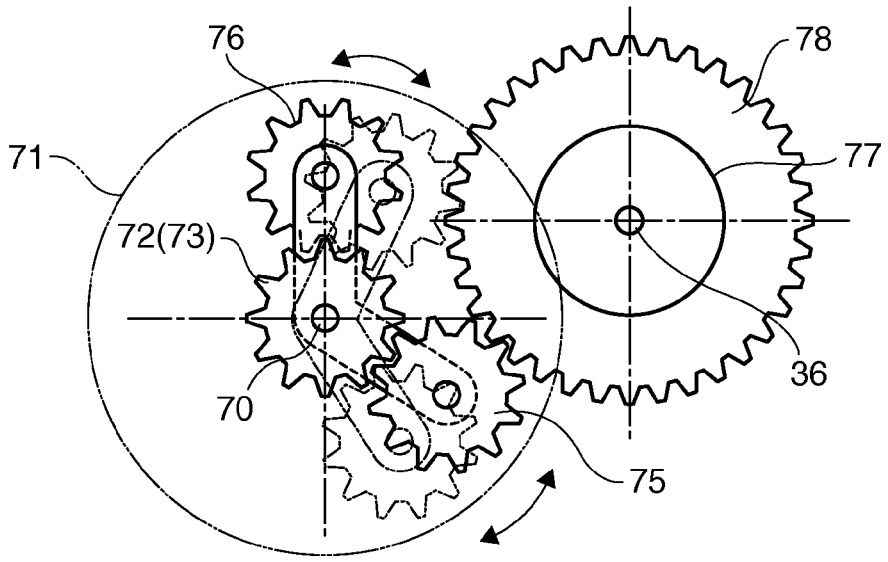
FIG. 4A is a side view and FIG. 4B is an oblique view showing part of the tractor-side drive power transfer mechanism.
Figure 4B:
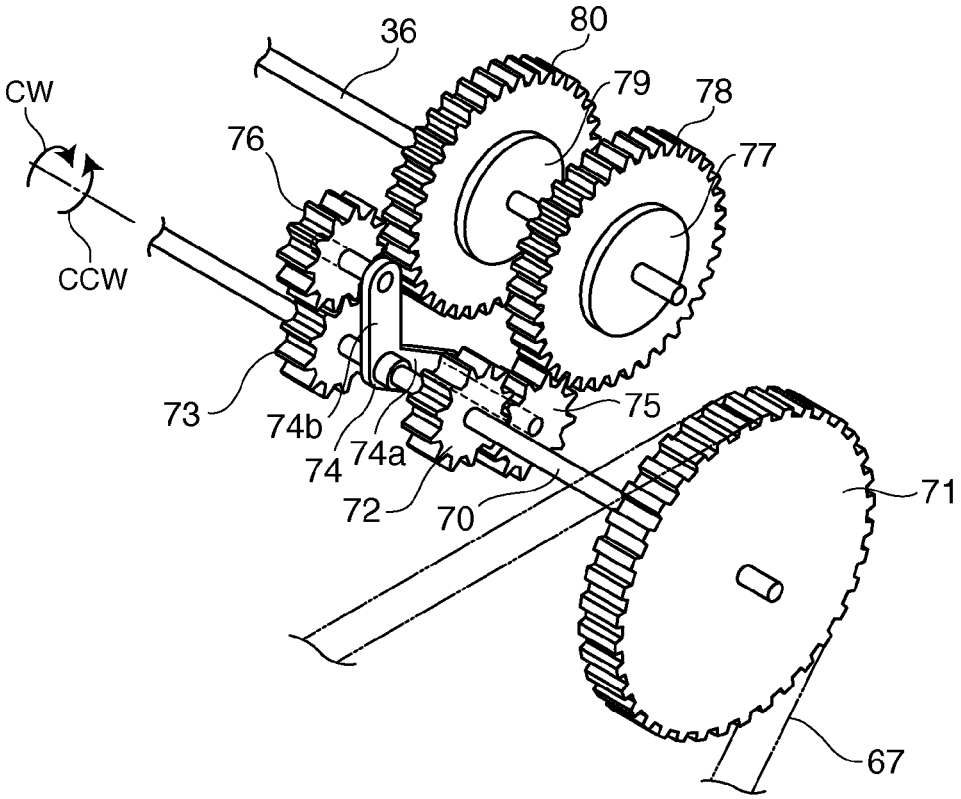

FIG. 4A and FIG. 4B, respectively, are a side view and an oblique view showing main parts of the tractor-side power transfer mechanism 62.

The tractor-side power transfer mechanism 62 has a rotating shaft 70, a transfer gear 71 is fixed coaxially to the rotating shaft 70, and the timing belt 67 is mounted on the transfer gear 71. A forward sun gear 72 and a reverse sun gear 73 are fixed coaxially on the rotating shaft 70. A planetary carrier 74 is supported freely pivotably on the rotating shaft 70 between the sun gears 72, 73.

The planetary carrier 74 has two arms 74*a*, 74*b* extending radially with a specific angle therebetween from the rotating shaft 70. A forward planetary gear 75 is supported freely rotationally on the end of one arm 74*a*. The forward planetary gear 75 meshes with the forward sun gear 72. A reverse planetary gear 76 is supported freely rotationally on the end of the other arm 74*b*. The reverse planetary gear 76 meshes with the reverse sun gear 73.

A forward transfer gear 78 is coaxially attached through the one-way clutch 77 to the end part of the tractor shaft 36. The one-way clutch 77 could be either a sprag clutch or cam clutch. The one-way clutch 77 transfers forward rotation, but turns freely and interrupts transfer of reverse rotation when reverse rotation for feeding the paper in reverse is received. The one-way clutch 77 therefore turns freely and the power transfer path is also interrupted while transferring forward rotation if a transfer member on the downstream side of the one-way clutch 77 on the transfer path tries to turn faster in the forward rotation direction than the transfer member on the upstream side of the transfer path.

The forward transfer gear 78 is a gear that can mesh with the forward planetary gear 75, and is disposed to a position opposite the forward planetary gear 75. A reverse transfer gear 80 is disposed beside the forward transfer gear 78. The reverse transfer gear 80 is attached coaxially to the end of the tractor shaft 36 through the torque limiter 79 (torque clutch).

The reverse transfer gear 80 is a gear that can mesh with the reverse planetary gear 76, and is disposed to a position opposite the reverse planetary gear 76. The torque limiter 79 slips when the transferred torque exceeds a specific limit, and limits transferring torque exceeding the limit.

In the tractor-side power transfer mechanism 62 thus comprised, the forward power transfer mechanism 64 is the part of the transfer mechanism that sequentially transfers rotation from the timing belt 67 through the rotating shaft 70, forward sun gear 72, planetary carrier 74, forward planetary gear 75, forward transfer gear 78, and one-way clutch 77 to the tractor shaft 36. The reverse power transfer mechanism 65 is the part that sequentially transfers rotation from the timing belt 67 through the rotating shaft 70, reverse sun gear 73, planetary carrier 74, reverse planetary gear 76, reverse transfer gear 80, and torque limiter 79 to the tractor shaft 36.

When transferring forward rotation, the rotating shaft 70 turns counterclockwise as indicated by arrow CCW in FIG. 4B due to the forward rotation of the conveyance motor 60. This rotation causes the planetary carrier 74 to also turn in the same direction. As a result, the forward planetary gear 75 meshes with the forward transfer gear 78. The reverse planetary gear 76 disengages the reverse transfer gear 80. As a result, forward rotation from the conveyance motor 60 is transferred through the roller-side power transfer mechanism 61 to the paper feed roller 41 and discharge roller 46. The forward rotation is also transferred through the tractor-side power transfer mechanism 62 to the tractors 31. The continuous paper 2 is therefore fed (conveyed) forward.

When transferring reverse rotation, the rotating shaft 70 turns clockwise as indicated by arrow CW in FIG. 4B due to the reverse rotation from the conveyance motor 60. This rotation causes the planetary carrier 74 to also turn in the same direction. As a result, the forward planetary gear 75 separates from and disengages the forward transfer gear 78, and the reverse planetary gear 76 approaches and engages the reverse transfer gear 80. As a result, reverse rotation from the conveyance motor 60 is transferred through the roller-side power transfer mechanism 61 to the conveyance rollers 41 and 46. The reverse rotation is also transferred through the tractor-side power transfer mechanism 62 to the tractors 31. The continuous paper 2 is therefore fed in reverse (reversed).

Continuous Paper

Figure 5:
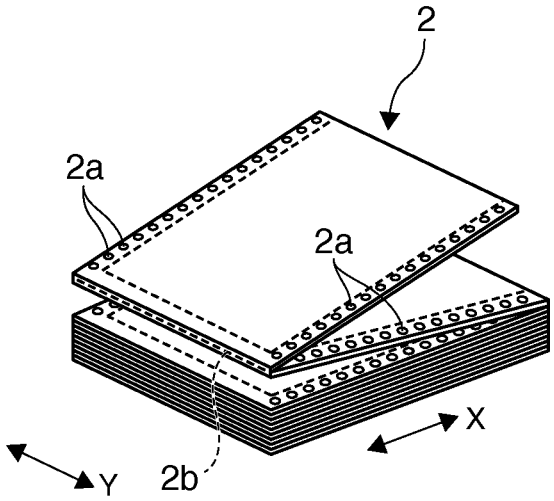
FIG. 5 is an example of continuous paper view.

FIG. 5 shows an example of continuous paper 2. Sprocket holes 2*a* (engagement holes) are formed along both widthwise edges of the continuous paper 2 at a specific pitch along the length of the continuous paper 2. A perforation 2*b* is formed transversely at a regular interval lengthwise to the continuous paper 2, and the continuous paper 2 is folded in opposite directions at each perforation 2*b* and stored in a fanfold stack. The free end of the top page of the continuous paper 2 is set in the inkjet printer 1, and the continuous paper 2 is pulled sequentially from the top of the stack and supplied into the inkjet printer 1. The continuous paper 2 can be easily separated into individual pages at the perforations 2*b*.

Sensors

The conveyance device 20 also includes paper detection sensors. More specifically, as shown in FIG. 1, a paper detector 81 is disposed between the first conveyance mechanism 22 and second conveyance mechanism 23 at a position near the paper feed roller 41 of the second conveyance mechanism 23. The paper detector 81 is, for example, a reflective photosensor, and detects continuous paper 2 conveyed by the first conveyance mechanism 22 toward the second conveyance mechanism 23 (conveyed forward).

A paper width detector 82 is disposed to the carriage 8 of the print unit 5. The paper width detector 82 in this embodiment is a reflective photosensor disposed to the carriage 8 at a position facing the conveyance path 21 (that is, facing down on the z-axis in FIG. 1). The paper width detector 82 emits a detection beam toward the platen on the bottom of the conveyance path 21, and detects the reflection from the platen or the continuous paper 2 conveyed over the platen. The left and right edges of the continuous paper 2 can be detected by the detection operation of the paper width detector 82 in conjunction with movement of the carriage 8 transversely to the paper conveyance direction. The width of the continuous paper 2 can be detected, and the conveyed continuous paper 2 can be detected based on the output of the paper width detector 82.

The conveyance device 20 also has a paper jam detector 83 disposed to the conveyance path 21 between the third conveyance mechanism 24 and the paper exit 6. The paper jam detector 83 includes a driven roller 84 and a driven pressure roller 85, an encoder 86 (rotation detection unit) that detects the angle (amount) of driven roller 84 rotation, and a guide member 87 that guides the continuous paper 2 between the driven roller 84 and driven pressure roller 85.

The driven roller 84 includes a roller 84*a* and roller shaft 84*b*, and is disposed transversely to the conveyance path 21 at a position below the conveyance path 21 on the z-axis. The driven pressure roller 85 is disposed to press the continuous paper 2 conveyed through the conveyance path 21 to the driven roller 84 from above on the z-axis.

The encoder 86 includes an encoder scale 86*a* disposed to the roller shaft 84*b* of the driven roller 84, and an optical sensor 86*b* disposed opposite the outside edge of the encoder scale 86*a*. Slits are formed at an equiangular interval in the outside edge of the encoder scale 86*a*, and the optical sensor 86*b* includes emitter and detector elements disposed with the slits therebetween.

The driven roller 84 rotates following movement of the continuous paper 2 passing between the driven roller 84 and driven pressure roller 85. If the pressure applied by the driven pressure roller 85 is too low, the driven roller 84 will slip against the continuous paper 2 and the driven roller 84 cannot be made to follow the continuous paper 2. To prevent the driven roller 84 from slipping relative to the continuous paper 2, the pressure applied by the driven pressure roller 85 is set so that the static friction between the continuous paper 2 and driven roller 84 is greater than the rotational load that causes the driven roller 84 to turn. Movement of the continuous paper 2 can therefore be reliably detected, and paper jams can be detected with good precision.

However, if the pressure from the driven pressure roller 85 is excessive and a wrinkle in the continuous paper 2 passes between the driven roller 84 and driven pressure roller 85, the roller pressure may crumple and skew the paper. In other words, if the driven pressure roller 85 applies too much pressure, the paper jam detector 83 may cause a paper jam.

If there is a large gap (length L in FIG. 1) between the driven roller 84 and the discharge roller 46 disposed near the driven roller 84 on the upstream side in the forward conveyance direction, wrinkles in the continuous paper 2 can be prevented from causing the continuous paper 2 to lift up before the driven roller 84, the paper can be prevented from crumpling due to the roller pressure, and paper jams can be avoided. Crumpling due to the roller pressure is also inhibited when the stiffness of the continuous paper 2 is sufficient (the paper is sufficiently stiff). The pressure of the driven pressure roller 85 is therefore set appropriately to the distance between the driven roller 84 and discharge roller 46, and the stiffness of the continuous paper 2. This configuration suppresses paper jams resulting from the continuous paper 2 passing between the driven roller 84 and driven pressure roller 85.

The pressure of the driven pressure roller 85 can be set using a method based on the pressure of the pressure roller 47 that presses the continuous paper 2 to the discharge roller 46 disposed on the upstream side of the driven roller 84 in the forward conveyance direction. For example, problems caused by excessive pressure from the driven pressure roller 85 can be prevented if half the pressure of the pressure roller 47 is the upper limit of the pressure applied by the driven pressure roller 85.

Control Unit

Signals from the paper detector 81, paper width detector 82, and the encoder 86 of the paper jam detector 83 are input to a control unit 90 that centrally controls the printing operation of the print unit 5 and the conveyance operation of the conveyance device 20. The control unit 90 is built around an electronic circuit including a CPU and ROM storing firmware. A print command from an external device not shown is input to the control unit 90. Signals from an encoder (not shown in the figure) that detects rotation of the drive sprocket 34 or driven sprocket 35 of the first conveyance mechanism 22, and an encoder (not shown in the figure) that detects rotation of the paper feed roller 41 of the second conveyance mechanism 23, are also input to the control unit 90. The printhead 7, carriage motor 12, and conveyance motor 60 are connected through drivers not shown to the output side of the control unit 90.

Conveyance Operation and Paper Jam Detection

In order to print on the continuous paper 2, the sprocket holes 2*a* formed in the sides of the continuous paper 2 are first engaged on the tractor pins 32 disposed to the tractors 31. When a print command is received, the control unit 90 first drives the conveyance motor 60 in the forward rotation direction. As a result, the tractors 31 and paper feed roller 41 are driven rotationally forward, and the continuous paper 2 is conveyed forward through the conveyance path 21. The continuous paper 2 conveyed by the tractor 31 is nipped between the rotating paper feed roller 41 and pressure roller 42, and further conveyed to a specific indexing position (the start position of the printing operation).

The control unit 90 determines the conveyance position of the continuous paper 2 based on the paper detector 81 detecting the leading end of the continuous paper 2 before the leading end of the continuous paper 2 reaches the paper feed roller 41 of the second conveyance mechanism 23. The control unit 90 also determines the conveyance position of the continuous paper 2 based on the paper width detector 82 detecting the leading end of the continuous paper 2 before the leading end of the continuous paper 2 reaches the printing position A. The control unit 90 controls conveyance of the continuous paper 2 based on the output of these sensors.

The forward conveyance speed of the paper feed roller 41 is set greater than the forward conveyance speed of the tractor 31 as described above. The holding force of the paper feed roller 41 is increased by the friction coating 45, but is less than the force with which the tractors 31 hold the sprocket holes 2*a*. When the continuous paper 2 is nipped between the paper feed roller 41 and pressure roller 42, the continuous paper 2 is therefore conveyed while being pulled with constant pressure on the paper feed roller 41 side. As a result, when fanfold paper that is supplied from a folded stack is used as the continuous paper 2, the continuous paper 2 can be supplied to the indexing position with folds and slack appropriately removed.

After the continuous paper 2 reaches the indexing position, the control unit 90 continues driving the conveyance motor 60 in the forward rotation direction, and executes the printing operation with the printhead 7 while conveying the continuous paper 2 through the conveyance path 21 with the paper feed roller 41. Because the friction coefficient of the friction coating 45 is extremely high, the continuous paper 2 is held between the paper feed roller 41 and pressure roller 42 with substantially no slipping, and the continuous paper 2 is conveyed with high precision. The tractors 31 feed the continuous paper 2 forward at a slower conveyance speed than the paper feed roller 41. The continuous paper 2 can therefore be constantly conveyed in a desirably tensioned state.

Rotational force for forward conveyance is transferred to the tractor 31 through the one-way clutch 77. If the tension on the continuous paper 2 exceeds a specific level, the tractor 31 is forcibly pulled strongly in the forward rotation direction by the paper feed roller 41. The tension on the continuous paper 2 does not increase, however, because the one-way clutch 77 turns freely in this event. The continuous paper 2 is therefore constantly conveyed forward in an appropriately tensioned state, and high quality printing is possible.

After the continuous paper 2 conveyed by the paper feed roller 41 passes the printing position A of the print unit 5 and is printed on by the printhead 7, the continuous paper 2 passes between the discharge roller 46 and pressure roller 47. The continuous paper 2 is then further conveyed through the conveyance path 21 by the discharge roller 46, continues between the driven roller 84 and driven pressure roller 85 of the paper jam detector 83 to the paper exit 6, and is discharged from the paper exit 6 to the discharge tray 16.

The driven roller 84 of the paper jam detector 83 turns following the movement of the continuous paper 2 passing between the driven roller 84 and driven pressure roller 85. The control unit 90 detects conveyance problems such as paper jams based on output from the encoder 86. If a paper jam is detected, the control unit 90 stops the printing operation of the print unit 5 and the conveyance operation of the conveyance device 20. The control unit 90 also controls specific display indicators or buzzers to report the problem to the user.

If the paper exit 6 is blocked for some reason and discharging the continuous paper 2 is obstructed in this embodiment, the continuous paper 2 will become stuck in the paper exit 6 end of the conveyance path 21 and a paper jam will occur. When the continuous paper 2 is detected by the paper detector 81 and paper width detector 82, that is, has finished passing through the conveyance path 21, the control unit 90 detects if a paper jam has occurred based on the output from the paper jam detector 83. More specifically, the control unit 90 determines that a paper jam or other conveyance problem has occurred if rotation of the driven roller 84 is not detected even though the conveyance motor 60 is still being driven after the continuous paper 2 has passed through the conveyance path 21. Alternatively, the angle of rotation (reference angle of rotation) of the driven roller 84 when the paper is normally conveyed may be stored, the difference between the detected angle of rotation and the reference angle of rotation calculated, and a paper jam or other conveyance problem detected based on the calculated difference.

When conveying the continuous paper 2 in reverse is necessary, the control unit 90 rotationally drives the conveyance motor 60 in the reverse rotation direction. This reverse rotation is conveyed through the roller-side power transfer mechanism 61 to the paper feed roller 41, and is transferred through the tractor-side power transfer mechanism 62 to the tractors 31. The tractor-side power transfer mechanism 62 interrupts the path of the forward power transfer mechanism 64 and connects to the reverse power transfer mechanism 65.

As described above, the conveyance speed of the continuous paper 2 by the tractor 31 during reverse conveyance is greater than the conveyance speed of the continuous paper 2 by the paper feed roller 41. Paper jams caused by slack or wrinkles when the continuous paper 2 is reversed with specific tension applied can be prevented. Rotation for reverse conveyance is also conveyed through the torque limiter 79 to the tractor shaft 36. When the transfer torque exceeds a specific limit, the torque limiter 79 turns freely (slips), and the transfer torque goes below the torque limit. If excessive tension is applied to the continuous paper 2, the torque limiter 79 turns freely and the tension on the continuous paper 2 goes below the limit. Problems such as excessive tension causing the sprocket holes 2*a* of the continuous paper 2 to escape from the tractor pins 32 can therefore also be prevented.

Because the paper jam detector 83 disposed to the conveyance device 20 according to this embodiment of the disclosure has a driven roller 84 that moves following the conveyed continuous paper 2 and an encoder 86 that detects rotation of the driven roller 84, paper jams that occur after the continuous paper 2 has finished passing through the conveyance path 21 and cannot be detected by the paper width detector 82 and paper detector 81 that detect the presence of continuous paper 2 can be detected. Furthermore, because the paper jam detector 83 is located downstream from the printing position A, paper jams occurring at a position on the conveyance path 21 on the downstream side in the forward conveyance direction can be detected quickly before the paper jam affects operation at the printing position A. Paper conveyance can therefore be stopped quickly, the continuous paper 2 removed from the conveyance path 21, and printhead problems caused by contact between the continuous paper 2 and printhead 7 can be suppressed.

A paper jam is detected only when conveyance of the continuous paper 2 through the conveyance path 21 has been detected based on signals from the paper detector 81 and paper width detector 82 disposed upstream. By detecting paper jams in conjunction with detection by an upstream detector, paper jams can be accurately detected, unnecessary detection processes can be avoided, and the processing load on the control unit 90 can be reduced.

The disclosure being thus described, it will be obvious that it may be varied in many ways. Such variations are not to be regarded as a departure from the spirit and scope of the disclosure, and all such modifications as would be obvious to one skilled in the art are intended to be included within the scope of the following claims.

What is claimed is:

1. A continuous paper conveyance device, comprising:

a tractor configured to convey a continuous paper through a conveyance path in a conveyance direction passing a printing position of a printhead while sequentially engaging parts in engaging holes formed along the length of the continuous paper;

a paper feed roller configured to convey the continuous paper through the conveyance path, and arranged at a position on the conveyance path between the tractor and the printing position;

a paper jam detector disposed on a downstream side of the printing position on the conveyance path, the paper jam detector including a driven roller configured to rotate following the continuous paper being conveyed, a rotation detection unit configured to detect an angle of rotation of the driven roller, and a driven pressure roller configured to press the continuous paper against the driven roller; and a discharge roller disposed on an upstream side of the paper jam detector on the conveyance path, wherein a pressure applied by the driven pressure roller is set according to (i) a distance in the conveyance direction between the discharge roller and the driven roller or (ii) a stiffness of the continuous paper, and a static friction between the driven roller and the continuous paper is greater than a rotational load of the driven roller.

2. The continuous paper conveyance device described in claim 1, further comprising:

a sensor configured to detect the continuous paper at a position on the upstream side of the printing position in the conveyance direction, wherein paper jam detection based on a signal from the rotation detection unit is performed based on the continuous paper detected by the sensor.

3. The continuous paper conveyance device described in claim 1, further comprising:

a friction layer of inorganic particles dispersed in a surface of the paper feed roller.

4. A printer, comprising:

the continuous paper conveyance device described in claim 1; and a print unit configured to print at the printing position on the continuous paper conveyed by the continuous paper conveyance device.

5. The printer described in claim 4, wherein:

the print unit has an inkjet head configured to eject ink droplets onto the continuous paper.

6. The continuous paper conveyance device described in claim 1, wherein the pressure applied by the driven pressure roller is set according to the distance in the conveyance direction between the discharge roller and the driven roller.

7. The continuous paper conveyance device described in claim 1, wherein the pressure applied by the driven pressure roller is set according to (i) the distance in the conveyance direction between the discharge roller and the driven roller, and (ii) the stiffness of the continuous paper.

* * * * *